US006752274B2

(12) United States Patent
Mirras

(10) Patent No.: US 6,752,274 B2
(45) Date of Patent: Jun. 22, 2004

(54) LOG WASHER WITH STAGGERED PADDLES

(76) Inventor: David Mirras, 975 N. 2nd Ave., Springfield, NE (US) 68059

( * ) Notice: Subject to any disclaimer, the term of this patent is extended or adjusted under 35 U.S.C. 154(b) by 174 days.

(21) Appl. No.: 10/075,239

(22) Filed: Feb. 15, 2002

(65) Prior Publication Data

US 2003/0155278 A1 Aug. 21, 2003

(51) Int. Cl.[7] ..... B03B 5/70

(52) U.S. Cl. ..... 209/464; 209/463; 209/461; 209/458

(58) Field of Search ..... 209/460, 458, 209/464, 463, 461, 172

(56) References Cited

U.S. PATENT DOCUMENTS

| | | | | |
|---|---|---|---|---|
| 15,827 A | * | 9/1856 | Thomas | 209/464 |
| 242,035 A | * | 5/1881 | Pierce | 209/492 |
| 1,609,652 A | | 12/1926 | McQueen | |
| 1,695,021 A | | 12/1928 | Puryear | |
| 1,972,195 A | | 9/1934 | Lacy, Jr. | |
| 2,025,841 A | | 12/1935 | Young | |
| 2,050,458 A | | 8/1936 | Ovestrud et al. | |
| 2,324,549 A | | 7/1943 | Wigton | |
| 2,336,991 A | | 12/1943 | Leveke | |
| 2,489,161 A | | 11/1949 | Scholes | |
| 3,807,558 A | | 4/1974 | Hamm | |
| 4,234,415 A | | 11/1980 | de Tuya Casuso | |
| 4,448,678 A | | 5/1984 | Gentry | |
| 5,868,256 A | | 2/1999 | Teppo | |

FOREIGN PATENT DOCUMENTS

| | | |
|---|---|---|
| WO | WO 97/16253 | 5/1997 |

* cited by examiner

*Primary Examiner*—Donald P. Walsh
*Assistant Examiner*—Kaitlin Joerger
(74) *Attorney, Agent, or Firm*—Richard C. Litman

(57) ABSTRACT

The log washer with staggered paddles is a device for washing and separating aggregates, such as sand, gravel, ores, etc., from waste material. The log washer has a water tank or trough having one end inclined or raised relative to horizontal. A pair of shafts are mounted for rotation in bearings in the end walls of the tank, and connected to a driver by appropriate gearing so that the shafts rotate in opposite directions. Each shaft has a plurality of paddles mounted thereon, each paddle being mounted at an angle to the shaft to raise washed aggregates up the inclined trough to a discharge hopper or conveyor belt. Further, the paddles on each shaft are grouped in sections, the radial angle formed by adjacent sections with the shaft being staggered, the paddles on adjacent shafts being offset so that the aggregate material is ground between the paddles.

14 Claims, 7 Drawing Sheets

LOG WASHER WITH STAGGERED PADDLES

BACKGROUND OF THE INVENTION

1. Field of the Invention

The present invention relates to apparatus for separating and washing clay, shale, and other contaminants from gravel, and particularly to a log washer having staggered paddles.

2. Description of the Related Art

Gravel is a commonly used material in the construction industry, being used in concrete, in paving, in landscaping, and as a component in other materials and the performance of other functions. Gravel may be obtained by strip mining techniques, from quarries, by dredging operations, and other methods. Typically gravel obtained by such methods will be mixed with clay mud balls or other soils, often containing grass, roots, and small wood or tree branch fragments, or with shale, sand, sandstone, limestone, or other earthen materials. In order to prepare gravel for market, it is necessary to separate the gravel from the earthen materials in which it is found, and to wash the gravel so that it is free from such contaminants.

Fine grades of gravel are usually separated and washed in devices which use a screw conveyor or auger, having a continuous, smooth, helical spiral blade about its circumference similar to the thread of a screw. Examples of such devices are shown in U.S. Pat. No. 1,695,021, issued Dec. 11, 1928 to Puryear (two parallel screws driven by planetary gears, with improved arrangement of water jets and valves for directing the flow of water in the tank), and in U.S. Pat. No. 2,025,841, issued Dec. 31, 1935 to Young (trough with screw conveyors and a novel de-shaling hopper for removing shale from gravel by water jets). Sometimes notches will be cut into the threads at regular intervals to break up clumped material, e.g., the cut-flight conveyor shown in FIG. 31 at page 1426 of Marks' Mechanical Engineers' Handbook (4th ed., 1941), U.S. Pat. No. 4,448,678, issued May 15, 1984 to Gentry (lignite separator with a single, hybrid shaft having a spiral lower end and a notched upper end).

Coarse gravel is usually separated and washed using log washers. Typical log washers have a water tank or trough mounted at an inclined angle relative to horizontal, with a pair of parallel shafts or logs mounted bearings in the end walls of the trough so that they are free to rotate. A motor is connected to one end of the shafts by appropriate gearing to drive the shafts to rotate in opposite directions. Each shaft has a plurality of paddles or blades mounted thereon, usually mounted to the shaft at an angle, the paddles on adjacent shafts being staggered so that mud balls and other clumps of material broken down by grinding between the blades of adjacent shafts, and so that the shafts carry solid rock and gravel material towards the raised end of the shaft, where the separated and washed gravel is discharged to an appropriate hopper or conveyor belt. Typically, in a conventional log washer, the paddles on a single shaft are mounted in long rows at equally spaced angular distances about the axis of the shaft, e.g., at 90° intervals.

Examples of conventional log washers with proposed improvements are disclosed in U.S. Pat. No. 1,609,652, issued Dec. 7, 1926 to McQueen (log washer with improved method of attaching the paddles to the shaft using keyways and aligned slots), and U.S. Pat. No. 3,807,558, issued Apr. 30, 1974 to Hamm (gravel separator using both sand screw and log washer where material introduced to trough lateral to screw or log washers into high velocity stream of water). U.S. Pat. No. 2,336,991, issued Dec. 14, 1943 to Leveke, shows a gravel washer with a single shaft having multiple sections of different diameters, one section being square in section, in which the sections are mounted eccentrically relative to the bearing to produce greater agitation in the trough.

The problem with conventional log washers is that the paddles on each shaft are mounted in straight rows. This configuration means that each time a row of paddles completes a revolution, the load in the tank of trough will be thrown or shifted laterally against the sidewalls of the tank. The lateral shifting of the load in the tank creates agitation and vibration along the entire length of the tank, at least four times per revolution in the case of log washers having four rows of paddles. The vibrations cause rocking in the tank supports, requiring that more time and effort be expended in preparing the foundation or supports for the tank or trough, and potentially result in greater wear and stress being placed on the bearings and/or the shaft. The present invention is directed towards a log washer shaft having staggered sections of paddles along each row, in order to reduce load shifting stresses, resulting in less strain and stress being placed upon the tank supports.

Other forms of separators are known for separating other mixtures of solids, having structures less related to the present invention, such as those described in the following patents: U.S. Pat. No. 1,972,195, issued Sep. 4, 1934 to Lacy, Jr. (ore washer with a chain and sprocket with buckets mounted on the chain to scoop material in a trough); U.S. Pat. No. 2,050,458, issued Aug. 11, 1936 to Ovestrud et al. (portable separator with a scrubber and a screen, but no log washers); U.S. Pat. No. 2,324,549, issued Jul. 20, 1943 to P. L. Wigton (separator with a spiral ribbon mounted on a shaft where the shaft is supported by a chain or belt); U.S. Pat. No. 2,489,161, issued Nov. 22, 1949 to Scholes (endless belt separator with improved seals); U.S. Pat. No. 4,234,415, issued Nov. 18, 1980 to de Tuya Casuso (ore separator with rotating drum); U.S. Pat. No. 5,868,256, issued Feb. 9, 1999 to Teppo (clay refiner with rotating drum); and International Patent No. WO 97/16253, published May 9, 1997 (rotating drum with inner and outer chambers).

None of the above inventions and patents, taken either singularly or in combination, is seen to describe the instant invention as claimed. Thus a log washer with staggered paddles solving the aforementioned problems is desired.

SUMMARY OF THE INVENTION

The log washer with staggered paddles is a device for washing and separating aggregates, such as sand, gravel, ores, etc., from clay, dirt, organic waste matter, and other impurities. The log washer has a water tank or trough having one end inclined or raised relative to horizontal. A pair of shafts are mounted for rotation in bearings in the end walls of the tank, and connected to a driver by appropriate gearing so that the shafts rotate in opposite directions. Each shaft has a plurality of paddles mounted thereon, each paddle being mounted at an angle to the shaft to raise washed aggregates up the inclined trough to a discharge hopper or conveyor belt. Further, the paddles on each shaft are grouped in sections, the radial angle formed by adjacent sections with the shaft being staggered, the paddles on adjacent shafts being offset so that the aggregate material is ground between the paddles.

The adjacent sections of paddles on each shaft are separated by transition zones characterized by an absence of paddles. The transition zones provide for enhanced scrubbing of the aggregate material.

Accordingly, it is a principal object of the invention to reduce the vibration in a log washer caused by shifting loads through staggering sections of paddles on the log washer shafts.

It is another object of the invention to relieve stress and strain on the supports of a log washer tank by staggering sections of paddles on the log washer shafts.

It is a further object of the invention to provide a log washer which separates aggregates from waste materials and washes the aggregate having smoother operation through staggering shifting loads in the log washer water tank.

Still another object of the invention is to reduce wear and tear on log washer tank supports, log washer shafts, and shaft bearings by offsetting sections of paddles in each row of log washer paddles.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
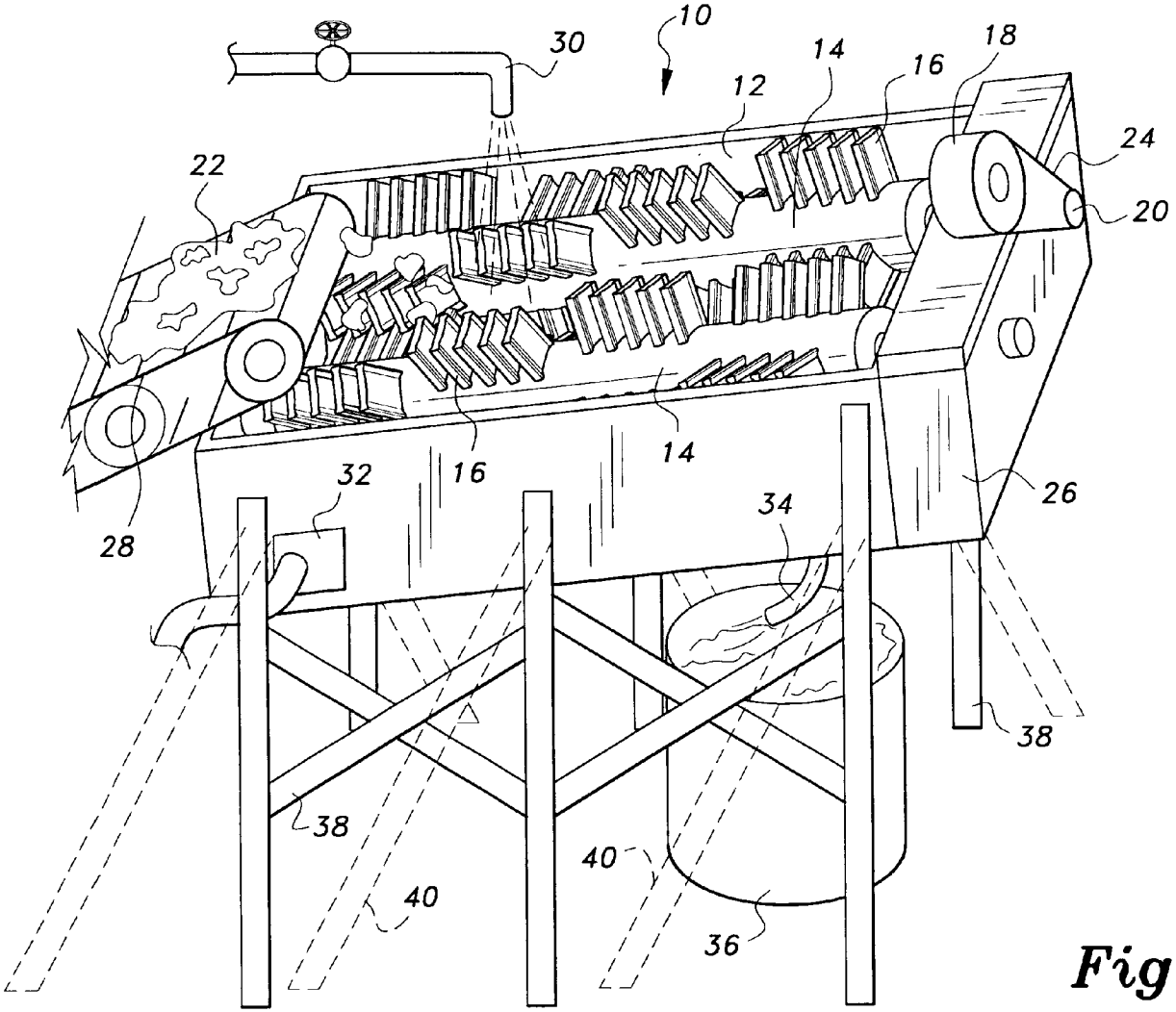
FIG. 1 is an environmental, perspective view of a log washer with staggered paddles according to the present invention.

The present invention is a log washer with staggered paddles, designated generally as 10 in the drawings. Log washers (the device is called a log washer as they were originally made with timber logs, rather than steel shafts) are used in quarries, dredging operations, strip mining, cement mills, sand and gravel pits, and other industries where it is desired to separate and clean aggregate materials, such as gravel, sand, ores, insoluble clays, etc., which has become clumped together and/or mixed with organic waste materials and the like. FIG. 1 shows a diagrammatic view of a typical log washer installation.

The log washer 10 has an elongated, open top enclosure which is variously referred to as a box, trough, tank, tub, stockade, but will be referred to as a trough 12 herein. A pair of shafts 14 are mounted in parallel in the end walls of the trough 12, each shaft 14 having a plurality of paddles 16 extending radially from the shaft 14. The shafts 14 are hollow and made from steel. A motor 18 or other prime mover is mounted at one end of the trough 12, the motor 18 driving a pulley 20 via an endless belt 24, the pulley 20 being connected to the end of one of the shafts 12 via a coupling or stub shaft (not shown), causing the shaft 14 to rotate. The shafts 14 are typically coupled to each other by a gear train housed in a gear box 26, the gear train being arranged to cause the two shafts 14 to rotate in opposite directions, i.e., one shaft 14 rotates in a clockwise direction while the other shaft 14 rotates in a counterclockwise direction. The ends of the shafts 14 opposite the motor 18 and gear box 26 are typically rotatably mounted in bearings (not shown) in the opposite end wall of the trough 12.

The trough 12 is typically canted so that it slopes at an angle between 0° and about 12° relative to horizontal, preferably about 8°. Crude aggregate material 22 is introduced at the lower end of the trough 12 by a conveyor belt 28 or the like, the aggregate 22 being dropped between the shafts 14. Water is introduced to the trough 12 in any of a variety of ways, such as with the aggregate, by means of an overhead sprayer 30, or by introducing a current of water from the bottom of the trough 12. The paddles 16 typically are mounted on the shaft 14 at an angle of about 25° and may be arcuate or cupped, so that the aggregate material 22 is scooped as the shafts 14 rotate and raised from the lower portion of the trough 12 to the upper portion of the trough 12 towards the gear box 26, the aggregate material 22 being crushed and ground between the shafts 14 as the paddles 16 mesh. Soluble waste material exits the trough 12 through adjustable gates 32, weirs or the like at the lower end of the trough 12. Cleaned aggregate material 22 is discharged at the upper end of the trough 12 through a conveyor belt or discharge chute 34 to a collection bin 36.

Frequently the log washer 10 must be installed with both ends elevated on scaffolding 38, A-frames, or other structural supports. Log washer troughs 12 may vary in length from about eighteen to thirty-five feet, in width from four feet to nine feet, and a depth of between two and one-half to four and one-half feet. The log washer 10 may accommodate a flow of water between about twenty-five gallons per minute to seven hundred fifty gallons per minute, depending upon the capacity of the trough 12. The weight of the log washer 10 may vary between about 9,000 pounds when unloaded to about 170,000 pounds when loaded, depending upon the size of the log washer. The shafts 14 may vary in length between about eighteen to thirty-five feet, and may have a diameter between six inches and forty-six inches. Each shaft 14 will typically have four rows of paddles 16, with between twenty-five to thirty-five paddles 16 per row. (The span between the tip end of one paddle 16 and the tip end of the paddle 16 180° opposite may be between twenty-four and forty-six inches; log washers are frequently distinguished by the paddle span and length of the tub, e.g., 26"×18'). Each shaft 14 may rotate between about twenty-six to forty-eight revolutions per minute.

Figure 6:
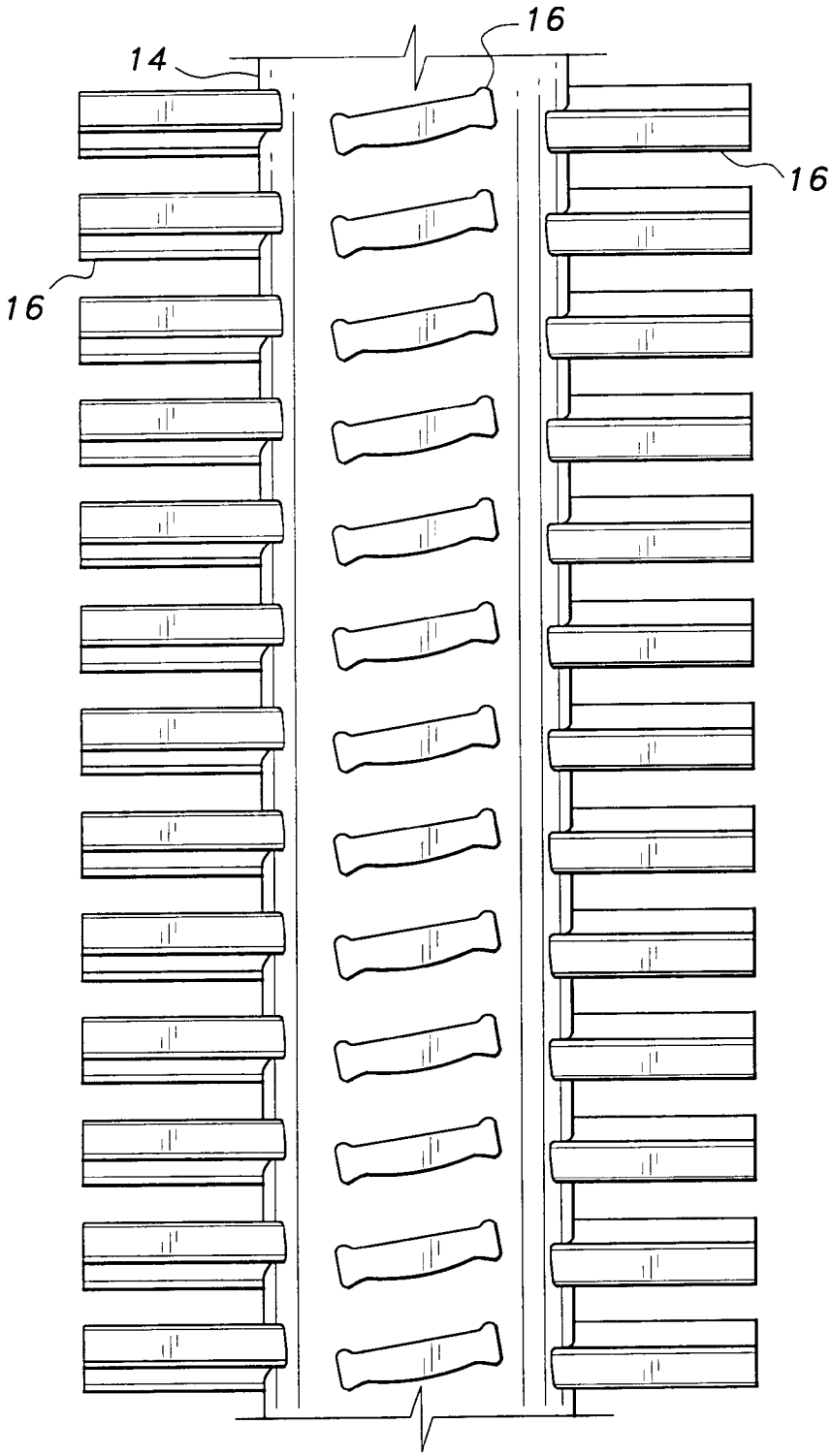
Fig. 6 (Prior Art)
FIG. 6 is a plan view of a log washer shaft of the prior art.
Figure 7:
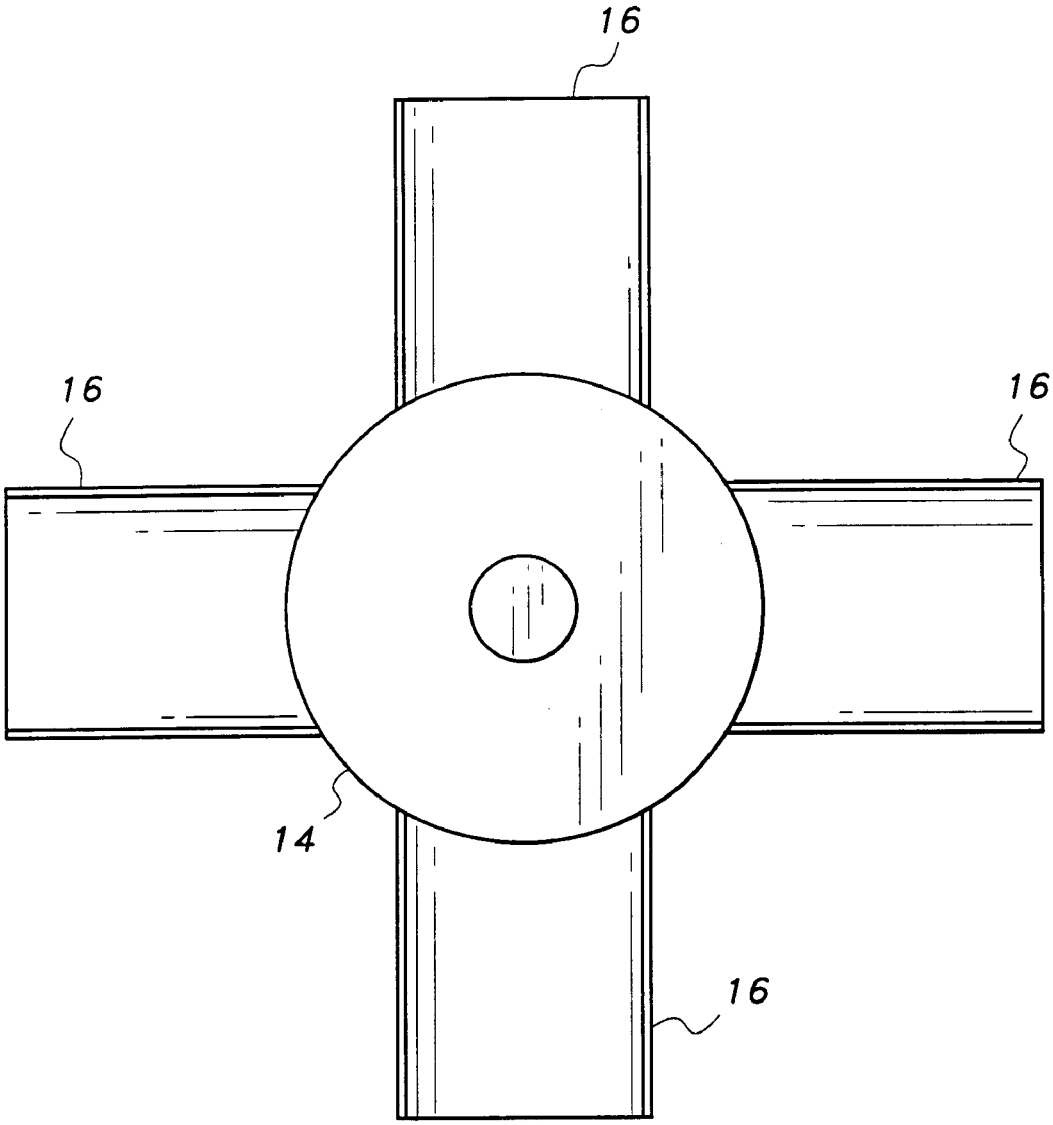
Fig. 7 (Prior Art)
FIG. 7 is an end view of a log washer shaft of the prior art.

In a conventional log washer 10, the four rows of paddles 16 will be spaced apart radially by about 90°, as shown in FIGS. 6 and 7. Consequently, the load, including water and aggregate material, is thrown laterally against the side walls of the trough 12 and against the bottom wall of the trough 12 four times per revolution, twenty-six to forty-eight times per minute, throughout the entire length of the shafts 14 and trough 12. Such lateral shifting of the load sets up mechanical vibrations throughout the length of the trough 12. These vibrations often require that additional bracing 40 be used to support the scaffolding 38, with resulting increase in material costs and set-up time. Mechanical vibrations from shifting of the load may also result in increased torsional stresses on the shafts 14 and on the bearings supporting the shafts 14, with consequent wear and maintenance and/or replacement costs.

Figure 2:
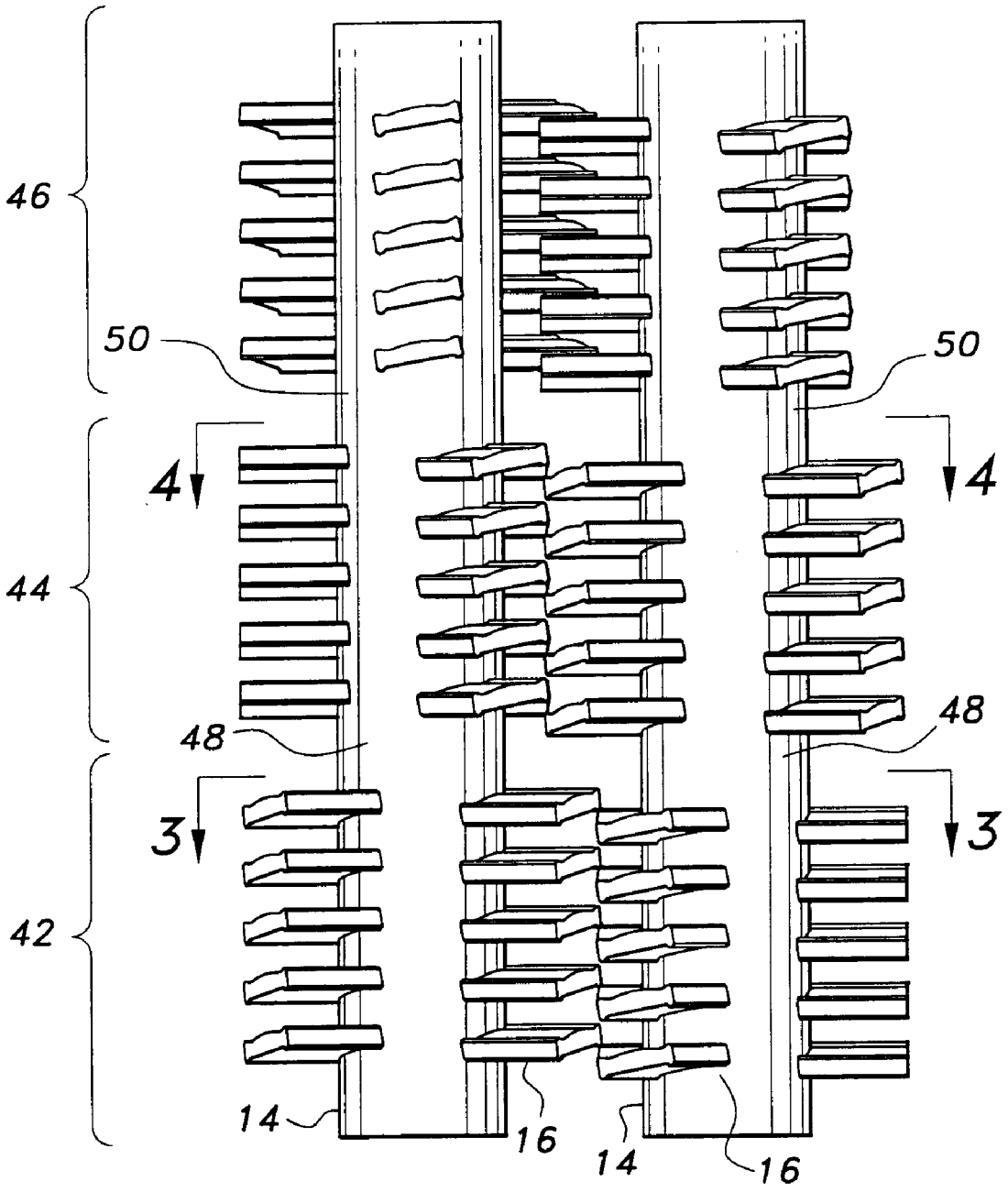
FIG. 2 is a plan view of two adjacent log washer shaft with staggered paddles according to the present invention.

Referring to FIGS. 2–5, the log washer 10 of the present invention reduces mechanical vibration and eliminates the need for additional bracing 40 by dividing each row of paddles 16 into sections and staggering the sections radially about the shaft 14. By way of illustration, each row of paddles 16 on the shafts 14 shown in FIG. 2 are divided into three sections, including a first section 42, a second section 44, and a third section 46. It will be noted that FIGS. 2–7 are diagrammatic, and not drawn to scale, the number of paddles 16 per shaft 14 and number of paddles 16 per section being reduced for purposes of illustration.

Figure 3:
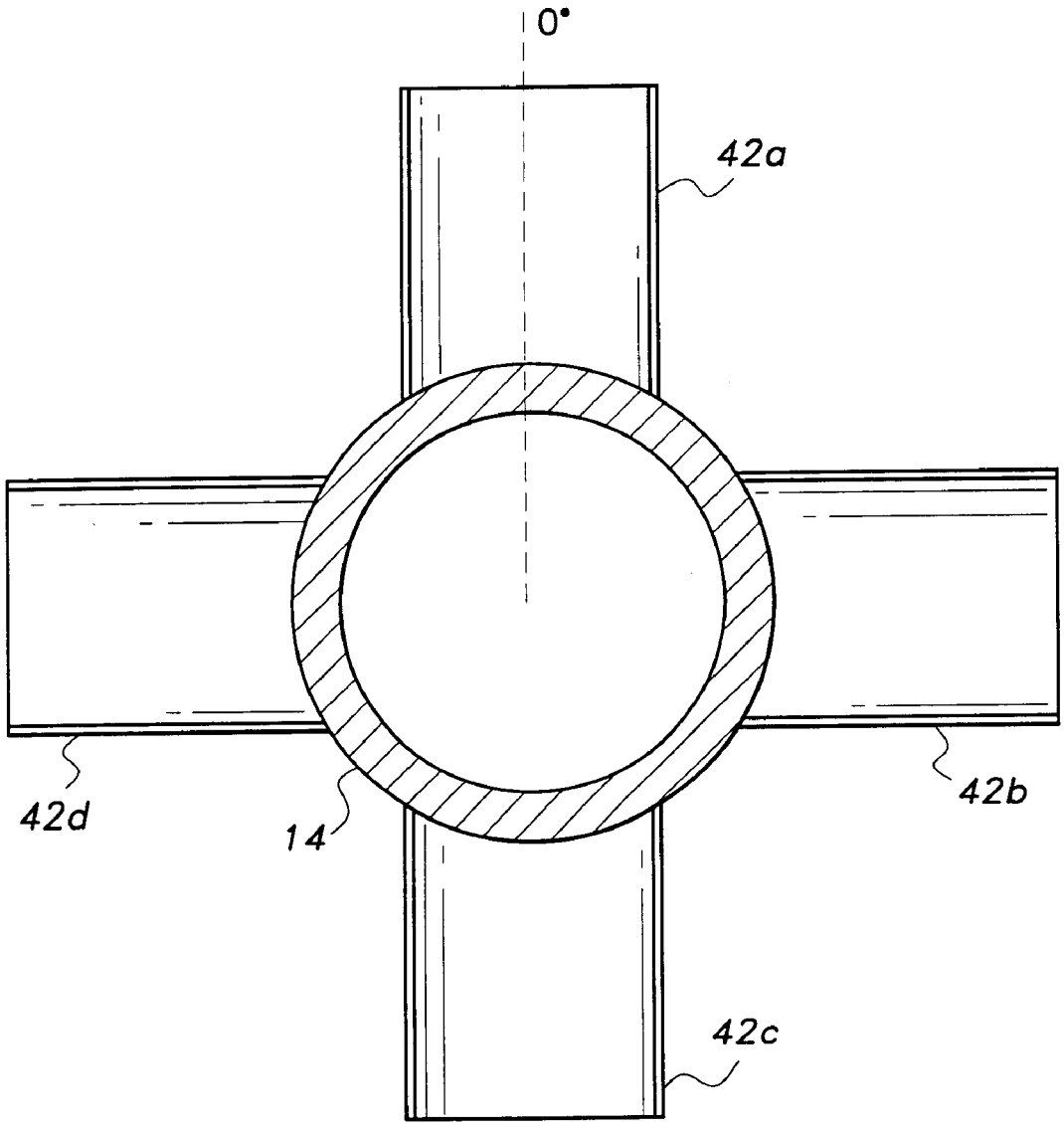
FIG. 3 is a section view along the lines 3—3 of FIG. 2.

As shown in FIG. 3 the paddles 16 in the first section 42 are divided into four rows 42*a*, 42*b*, 42*c* and 42*d* which are spaced apart radially by 90°. This results in the paddles 16 of the first section 42 being spaced apart in rows centered at 0°, 90°, 180° an 270° radially about the shaft 14. Paddles 16 in adjacent rows, e.g., 42*a* and 42*b* are staggered axially on the shaft 14 due to the size of the paddles 16.

Figure 4:
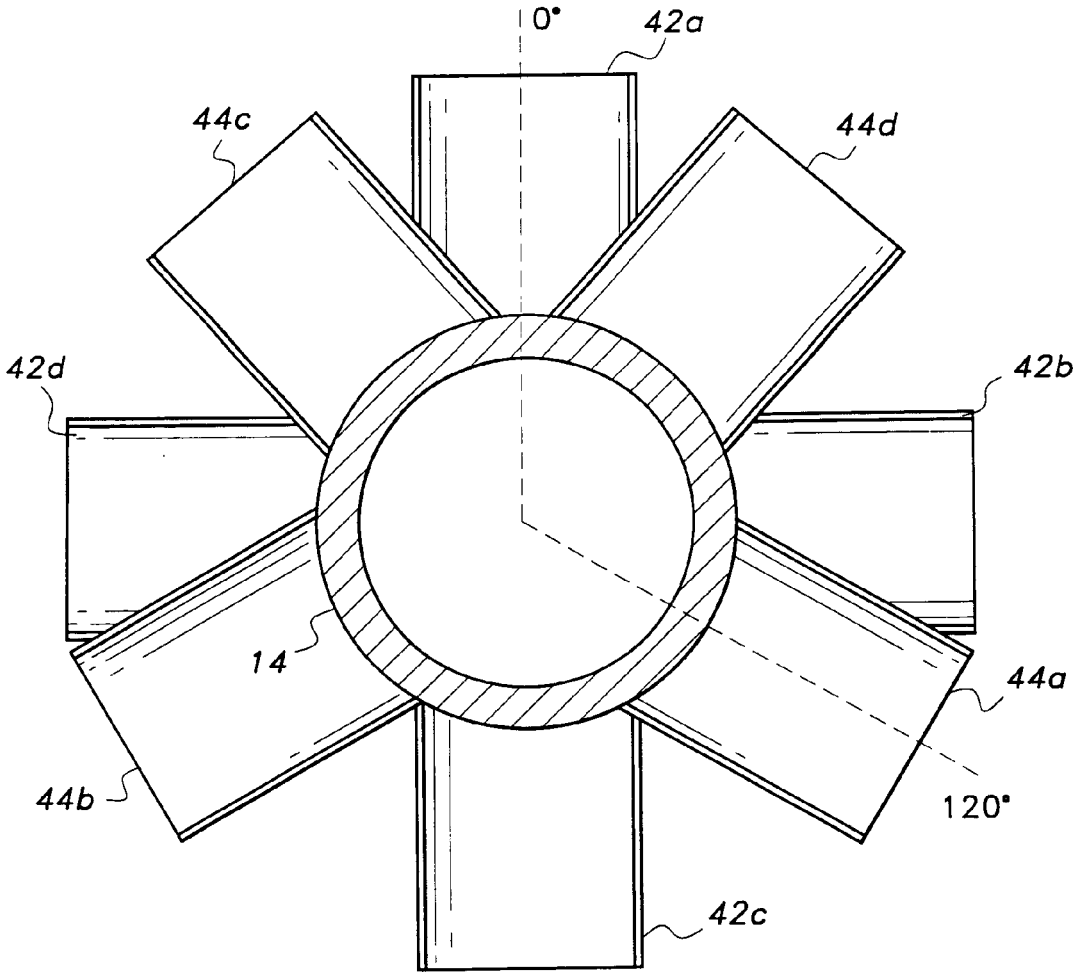
FIG. 4 is a section view along the lines 4—4 of FIG. 2.

As shown in FIG. 4, the paddles 16 in the second section 44 are also divided into four rows 44*a*, 44*b*, 44*c*, and 44*d* which are spaced apart radially by 90°. However, unlike the conventional log washer shaft 14 shown in FIGS. 6 and 7, the row 44*a* is not linearly aligned with row 42*a*, but is staggered radially by 120°, so that the rows in section 44 extend radially at 120°, 210°, 300°, and 30°, as shown by the dashed 0° and 120° reference lines.

Figure 5:
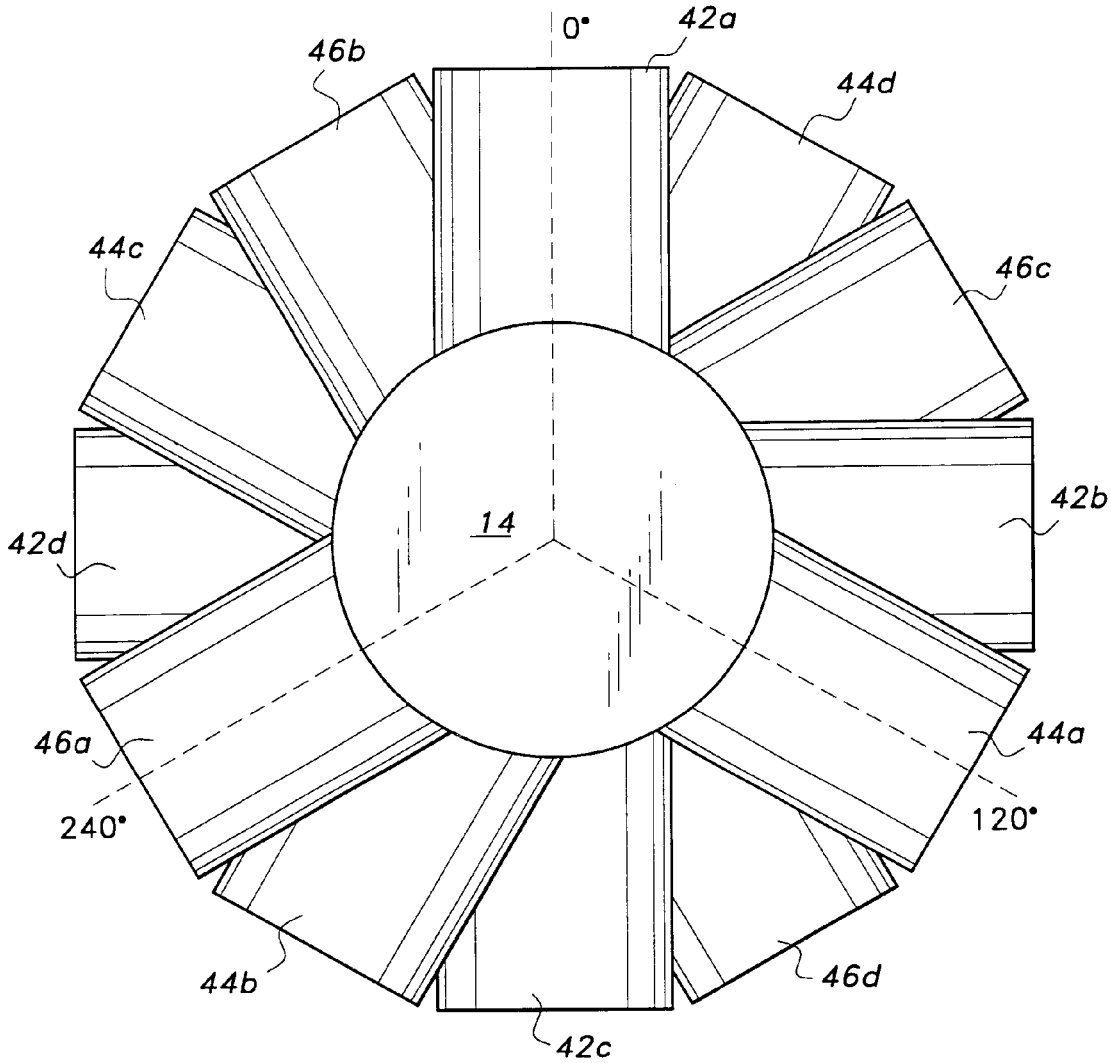
FIG. 5 is an end view of a log washer shaft with staggered paddles according to the present invention.

As shown in FIG. 5, the paddles 16 in the third section 46 are also divided into four rows 46*a*, 46*b*, 46*c*, and 46*d* which are spaced apart radially by 90°. The row 46*a* is not linearly aligned with the rows 42*a* or 44*a*, but is staggered by 240° radially relative to the row 42*a*, as shown by the dashed 0°, 120°, and 240° reference lines, so that the rows in section 46 extend radially at 240°, 330°, 60°, and 150°. Thus, rows a, b, c, and d are divided into sections 42, 44, and 46, respectively, which each of the sections 42, 44, and 46 being staggered radially.

Consequently, the entire load in the trough 12 is not shifted simultaneously against the walls of the trough 12 four times per revolution. Rather, the load is thrown against the upper one-third of the length of the trough 12, the middle one-third, and the lower one-third of the length of the trough 12 four times per revolution, but staggered in time by one-twelfth of a revolution. Hence the stresses generated by shifting the load are distributed over time throughout the length of the trough 12, reducing mechanical vibration.

Another factor contributing to reduction in mechanical vibration are the transition zones 48 and 50 between the sections 42, 44, and 46. The transition zones 48 and 50 are regions of the shaft 14 characterized by an absence of paddles which separate the sections and have an axial length of about three inches greater than the separation between paddles 16. The transition zones are required to maintain the spacing between paddles 16 of successive sections, and also contribute to damping of the trough vibrations. The load is raised from the lower end of the trough 12 to the higher end within the sections 42, 44, and 46 by action of the paddles 16, and is pushed through the transition zones 48 and 50 by accumulated aggregate 22 as the aggregate 22 clears each section.

It will be understood by those skilled in the art that the principles of the present invention have been illustrated by dividing the rows of paddles 16 on each shaft 14 into three sections 42, 44, and 46, but that the scope of the invention may extend to any embodiment which divides the rows into a plurality of sections and staggers the sections radially about the shaft 14, optimally between two and five sections depending upon the length of the shaft 14, three sections being preferable. It will further be understood that although the invention has been illustrated with successive sections being staggered by 120° radially, that the successive sections may be staggered by any other desired angular measure.

The paddles 16 (sometimes referred to as blades) may be unitary in construction, or they may be two piece in construction, having a stud or lug welded or bolted to the shaft and a cover bolted to the lug. The paddles 16 may have any desired shape, such as a fluted paddle for coarse aggregate or slurry paddles for washing clay.

It is to be understood that the present invention is not limited to the embodiments described above, but encompasses any and all embodiments within the scope of the following claims.

I claim:

1. A log washer shaft with staggered paddles, comprising:

(a) an elongated shaft having opposing ends; and (b) a plurality of paddles, the paddles extending radially from said shaft, the paddles being aligned in a plurality of rows extending from one end of said shaft to the opposing end of said shaft, each row being grouped into a plurality of sections of paddles having each paddle in the section extending from said shaft at an identical radial angle, wherein successive sections of paddles in each row are staggered by a predetermined radial angle;

(c) wherein said shaft is sized and dimensioned for rotatable mounting in a log washer.

2. The log washer shaft with staggered paddles according to claim 1, wherein successive sections of paddles in each said row of paddles are staggered by a radial angle of 120°.

3. The log washer shaft with staggered paddles according to claim 1, wherein said plurality of paddles are aligned into four rows, each row being separated radially by 90°.

4. The log washer shaft with staggered paddles according to claim 3, wherein each of said four rows is divided into three sections of paddles, the sections in each row being staggered radially by an angle of 120°.

5. The log washer shaft with staggered paddles according to claim 1, wherein successive sections of paddles are separated by a transition zone characterized by an absence of paddles.

6. The log washer shaft with staggered paddles according to claim 1, wherein each said row of paddles is grouped into between two and five sections of paddles.

7. The log washer shaft with staggered paddles according to claim 1, wherein each said paddle is mounted at an angle relative to the shaft.

8. A log washer with staggered paddles, comprising:

(a) an elongated trough;

(b) means for introducing a stream of water into said trough;

(c) a pair of elongated shafts having opposing ends, the shafts being rotatably mounted in said trough, said shafts being mounted in parallel relation;

(d) a plurality of paddles, the paddles extending radially from each of said shafts, the paddles on each said shaft being aligned in a plurality of rows extending from one end of said shaft to the opposing end of said shaft, each row being grouped into a plurality of sections of paddles, wherein successive sections of paddles in each row are staggered by a predetermined radial angle, and wherein the paddles on said shafts interlace as said shafts are rotated;

(e) means for rotating said shafts in opposite directions;

(f) means for removing waste from said trough; and (f) a discharge chute connected to said trough for removing washed and separated aggregate from said trough;

(g) wherein said trough is canted relative to horizontal so that the trough has a lower end and an upper end, clumped aggregate being introduced to the lower end of said trough between said shafts, the aggregated being separated, washed, and transported to the upper end of said trough by rotation of said shaft, the staggering of the sections of paddles reducing vibration of the log washer.

9. The log washer according to claim 8, wherein successive sections of paddles in each said row of paddles are staggered by a radial angle of 120°.

10. The log washer according to claim 8, wherein said plurality of paddles are aligned into four rows, each row being separated radially by 90°.

11. The log washer according to claim 10, wherein each of said four rows is divided into three sections of paddles, the sections in each row being staggered radially by an angle of 120°.

12. The log washer according to claim 8, wherein successive sections of paddles are separated by a transition zone characterized by an absence of paddles.

13. The log washer according to claim 8, wherein each said row of paddles is grouped into between two and five sections of paddles.

14. The log washer shaft with staggered paddles according to claim 8, wherein each said paddle is mounted at an angle relative to the shaft.

* * * * *